US006113449A

United States Patent [19]

Sung et al.

[11] Patent Number: 6,113,449

[45] Date of Patent: Sep. 5, 2000

[54] METHOD OF FABRICATING A FRONT PLATE FOR A PLASMA DISPLAY PANEL

[75] Inventors: Wen-Fa Sung, Hsinchu; Jin-Yuh Lu, Miaoli Hsien; Yao-Ching Su, Tainen Hsien, all of Taiwan

[73] Assignee: Acer Display Technology, Inc., Hsinchu, Taiwan

[21] Appl. No.: 09/351,969

[22] Filed: Jul. 12, 1999

[30] Foreign Application Priority Data

Jul. 13, 1998 [TW] Taiwan ..... 87111339

[51] Int. Cl.[7] ..... H01J 9/02

[52] U.S. Cl. ..... 445/24; 430/315

[58] Field of Search ..... 430/311, 315; 445/24, 52

[56] References Cited

U.S. PATENT DOCUMENTS 4,948,706 8/1990 Sugihara et al. ..... 430/311

5,725,407 3/1998 Liu et al. ..... 445/52

*Primary Examiner*—Kenneth J. Ramsey

*Attorney, Agent, or Firm*—Ladas & Parry

[57] ABSTRACT

A front plate for a plasma display panel (PDP) and its modified fabricating method are provided using a backside exposure process and an appropriate processing sequence rearrangement to reduce the number of photomasks required and improve the accuracy of exposure and developing process. First, a light-shielding layer is patterned by performing a mesh printing process, or by performing an exposure and developing process using a first photomask, so as to form a light-shielding structure including black stripes and transparent electrodes' gaps. Next, using the light-shielding structure as a mask, a backside exposure and developing process as well as an etching process is performed to form a plurality of pairs of transparent electrodes on the substrate. Then, using a second photomask, another set of exposure, developing and etching processes are performed to form a plurality of pairs of metal electrodes on the corresponding transparent electrodes.

7 Claims, 7 Drawing Sheets

METHOD OF FABRICATING A FRONT PLATE FOR A PLASMA DISPLAY PANEL

BACKGROUND OF THE INVENTION

1. Field of the Invention

This invention relates in general to the fabrication of a flat panel display, and more particularly to a structure of a front plate for a plasma display panel (PDP) and a modified method of fabricating the front plate capable of reducing the number of photomasks required and improving the accuracy of the exposure and developing process.

2. Description of Related Art

Plasma display panels (PDPs) are generally classified into the DC type (or direct discharge type), in which the discharging electrodes are exposed in the discharge space, and the AC type (or indirect discharge type), in which the discharging electrodes are covered with a dielectric layer. AC type PDPs are further classified into two types: one is a facing surfaces charging type in which the discharging electrodes are provided onto two substrates of back and front sides respectively; the other is a surface discharge type in which the discharging electrodes are provided onto only one of two substrates of back and front sides.

The AC type PDP is driven by a voltage application method such as the refreshing method, the matrix addressing method, the self-shifting method, etc. FIG. 1, for example, shows a surface discharge AC type PDP with a matrix addressing method which comprises a front plate 10 and a back plate 11 facing and parallel to each other, and a discharge gas space 18 defined by these substrates and barrier ribs of an insulating material (not shown). The barrier ribs partition pixel cells to prevent adjacent cells from leaking ultraviolet rays produced by the electrical discharge.

In the front plate 10, a plurality of pairs of sustaining electrodes are formed parallel to each other on the inside as row electrodes per one pixel cell. Each sustaining electrode comprises a transparent electrode 12 and a metal electrode 12*a* with a narrower width thereon. As illustrated in FIG. 1, a gap G is shown between each pair of the transparent electrodes. A dielectric layer 13 is uniformly formed on and over the sustaining electrodes. A protective layer 14, such as a MgO layer, is then formed on the dielectric layer 13.

In the back plate 11, address electrodes 15 are formed parallel to each other on the inside as column electrodes in such a manner that each address electrode crosses a sustaining electrode. Fluorescent layers 16 are formed on the internal surface of the back plate 11 so as to correspond to unit pixel cells, respectively. The front plate 10 and the back plate 11 are assembled after being aligned in a way that each address electrode and each sustaining electrode crossover apart from each other at an intersection space 18 for a discharge-oriented emission corresponding to one pixel cell, and then the discharge space 18 is filled with a rare gas mixture. In this way, a surface discharge type PDP is manufactured.

This PDP is operated as follows: when a predetermined voltage is applied across each pair of the address electrodes and the sustaining electrodes embedded in the dielectric layer 13, a discharging region appears above the dielectric layer 13 at the crossover point of each pair of electrodes in the gaseous space 18. Ultraviolet rays emitted from the discharging region stimulate the fluorescent layer 16 to emit light radiating through the front plate 10 as an emission region. This discharged emission is maintained by a sustaining voltage applied between the sustaining electrodes, but canceled by an erase pulse applied between the address electrodes.

The PDP has been considered the most suitable flat device for a large size displays (i.e., those exceeding over 20 inches) because high-speed display is possible and a large size panel can easily be made. In the conventional fabrication of a front plate of the PDP, three photomasks are required to perform the necessary exposure and developing processes. These include a photomask for transparent electrodes, a photomask for metal electrodes, and a photomask for black stripes. When performing the exposure process, a charge-coupled device (CCD) is used to detect an alignment mark on the substrate, and then a step motor is used to position the substrate or the photomask accordingly to ensure the highest alignment accuracy. As the manufacture steps proceeding, several layers of different materials are successively formed on the substrate; the alignment mark should be always transferred onto the upper most layer.

However, if the alignment mark is transferred to a layer with high transparency, such as a transparent electrode, the normal auto-alignment exposure process cannot be achieved since the stepper is unable to detect the alignment mark. Therefore, a manual exposure process should be performed as an alternative, which not only increases the process time in a manner unfavorable to manufacturing efficiency, but also reduces the exposure accuracy and thus influences the uniformity of the product device. To achieve a good understanding the above-mentioned problem, please now refer to FIGS. 2A to 2J showing the processing steps of fabricating a front plate for a plasma display panel by a prior art method.

First, as shown in FIG. 2A, a substrate 20 such as a glass plate is provided. A transparent conductive layer 21, such as an Indium tin oxide (ITO) layer, is formed overlying the surface of the substrate 20. Next, referring to FIG. 2B, a negative-type photoresist layer 22 is coated on the transparent conductive layer 21. An exposure and developing process is then performed by using a first photomask 23 to define a photoresist pattern 22*a* that covers portions of the transparent conductive layer 21 for forming transparent electrodes, as can be seen in FIG. 2C. Then, the transparent conductive layer 21 is etched using the photoresist pattern 22*a* as a mask to form a plurality of pairs of transparent electrodes 21*a* parallel to each other. After removing the photoresist pattern 22*a* by using an appropriate solvent or dry etching, the resulting structure is shown in FIG. 2D.

Then, as can be seen in FIG. 2E, a laminated metal layer 24 is formed on the transparent electrodes 21*a* and the substrate 20. For example, the laminated metal layer 24 includes a chromium layer 241, a copper layer 242, and another chromium layer 243 (Cr/Cu/Cr). Referring to FIG. 2F, a positive photoresist layer 25 is coated on the laminated metal layer 24. A second exposure and developing process is then performed by using a second photomask 26 to define a photoresist pattern 25*a* that covers portions of the laminated metal layer 24 for forming metal electrodes, as can be seen in FIG. 2G. Then, the laminated metal layer 24 is etched using the photoresist pattern 25*a* as a mask to form a plurality of pairs of metal electrodes 24*a* on the corresponding transparent electrodes 21*a*. After removing the photoresist pattern 25*a* by using an appropriate solvent or dry etching, the resulting structure is shown in FIG. 2H.

Referring to FIG. 21, a light-shielding layer 27, such as the PbO—$Ba_2O_3$—$SiO_2$ series materials layer, is formed overlying the exposed surfaces of the transparent electrodes 21*a*, the metal electrodes 24*a* and the substrate 20. Using a third photomask 28, a third exposure and developing process is then performed to the light-shielding layer 27 to form a plurality of so-called black stripes (also called black belts) 28 on the gaps between each pair of the transparent electrodes 21*a*. Thereafter, a dielectric layer and a passivation layer (not shown) are successively formed to complete the fabrication of the front plate for a PDP.

In the above conventional fabricating process, the first photomask 23 is auto-aligned to a desired position either by a side-by-side alignment or by using a predefined alignment mark. This can be done easily within 10 seconds using today's manufacturing platen. However, this auto-alignment scheme cannot be achieved when the second photomask is used, because the alignment mark is transferred onto the transparent conductive layer 21. Since the exposure platen's detector is unable to detect the transparent alignment mark automatically, a manual alignment process is performed instead. This results in the increase of the processing time and the reduction of the exposure accuracy. After that, the alignment mark is transferred onto the laminated metal layer 24. The auto-alignment scheme again can be applied to the third photomask to execute another exposure process.

Hence, a modified method of fabricating a front plate for a PDP has been disclosed, which is able to perform all of the exposure and developing processes using auto-alignment changing the sequence of forming the transparent electrodes and the metal electrodes. A detailed explanation of this prior art modified method is described with reference to accompanying FIGS. 3A to 3I. First, as shown in FIG. 3A, a substrate 20 such as a glass plate is provided. Next, a transparent conductive layer 21, such as an Indium tin oxide (ITO) layer; and a laminated metal layer 24, for example, a stacked structure of chromium layer 241/copper layer 242/chromium layer 243 (Cr/Cu/Cr) are formed successively overlying the substrate 20.

Referring to FIG. 3B, a positive-type photoresist layer 25 is coated on the laminated metal layer 24. An exposure and developing process is then performed by using the second photomask 26 to define a photoresist pattern 25*a* that covers portions of the laminated metal layer 24 for forming metal electrodes, as can be seen in FIG. 3C. Next, the laminated metal layer 24 is etched using the photoresist pattern 25*a* as a mask to form a plurality of pairs of metal electrodes 24*a*, as shown in FIG. 3D. After that, the photoresist pattern 25*a* is removed by using an appropriate solvent or dry etching.

Subsequently, referring now to FIG. 3E, a negative-type photoresist layer 29 is coated on the transparent conductive layer 21 and the metal electrodes 24*a*. Another exposure and developing process is then performed by using the first photomask 23 to define a photoresist pattern 29*a* that covers portions of the transparent conductive layer 21 for forming transparent electrodes, as can be seen in FIG. 3F. The transparent conductive layer 21 is etched using the photoresist pattern 29*a* as a mask to form a plurality of pairs of transparent electrodes 21*a* parallel to each other. After removing the photoresist pattern 29*a* by using an appropriate solvent or dry etching, the resulting structure is shown in FIG. 3G.

Referring to FIG. 3H, a light-shielding layer 27, such as the PbO—$Ba_2O_3$—$SiO_2$ series materials layer, is formed overlying the exposed surfaces of the transparent electrodes 21*a*, the metal electrodes 24*a* and the substrate 20. Using the third photomask 28, a third exposure and developing process is then performed to the light-shielding layer 27 to form a plurality of black stripes 27*a* on the gaps between each pair of transparent electrodes 21*a*, as can be seen in FIG. 31. Thereafter, a dielectric layer and a passivation layer (not shown) are successively formed to complete the fabrication of the front plate for a PDP.

Compared to the conventional method described in FIGS. 2A to 2J, this prior art modified method is able to perform the entire exposure process in an auto-alignment scheme. First, the second photomask 26 is used to define the photoresist pattern 25*a* with an auto-aligned exposure and developing process. Next, an auto-alignment can be achieved in the exposure process using the first photomask 23 since the alignment mark transferred onto the laminated metal layer 24 is easily detected by the exposure platen's detector. Finally, the alignment mark in the laminated metal layer 24 is utilized to execute another auto-aligned exposure process for forming the black stripes 27*a* in the exposure process that uses the third photomask 28. With this entirely auto-aligned scheme, the exposure accuracy and the production efficiency can be improved. However, along with the continuous development of PDP manufacture technology, there remains a need to make further modifications to the processing steps to achieve better production efficiency.

SUMMARY OF THE INVENTION

It is therefore an object of the present invention to provide a structure of a front plate for a PDP and its modified fabricating method without having to use any manual-aligned exposure process, thus preventing the drawbacks incurred with the prior art method and improving the exposure accuracy and production efficiency.

It is another object of the present invention to provide a modified method of fabricating a front plate for a PDP that is able to minimize the number of photomasks required, thereby reducing the complexity of device fabrication.

To fulfill the objects of the present invention, a modified method of fabricating a front plate for a plasma display panel (PDP) is provided which utilizes a backside exposure process and an appropriate processing sequence rearrangement to reduce the number of photomasks requited and improve the accuracy of the exposure and developing process. First, a light-shielding layer is patterned by performing a mesh printing process, or by performing an exposure and developing process using a first photomask, so as to form a light-shielding structure including black stripes and transparent electrodes' gaps. Next, by using the light-shielding structure as a mask, a backside exposure and developing process as well as an etching process are performed to form a plurality of pairs of transparent electrodes on the substrate. Then, using a second photomask, another set of exposure, developing and etching processes are performed to form a plurality of pairs of metal electrodes on the corresponding transparent electrodes.

According to a preferred embodiment of the present invention, a method of fabricating a front plate for a PDP includes the steps of: (a) forming a light-shielding layer on a substrate; (b) performing a mesh printing process, or performing an exposure and developing process by using a first photomask, so as to pattern the light-shielding layer to form a light-shielding structure including black stripes and transparent electrode gap stoppers; (c) forming a transparent conductive layer overlying the upper surfaces of the light-shielding structure and the substrate; (d) coating a first photoresist layer on the transparent conductive layer; (e) using the light-shielding structure as a mask, performing a backside exposure and developing process to the first photoresist layer to reveal a portion of the transparent conductive layer over the light-shielding structure; (f) successively removing the exposed portion of the transparent conductive layer and the first photoresist layer, thereby leaving a plurality of pairs of transparent electrodes on the substrate; (g) forming a laminated metal layer overlying the transparent electrodes and the light-shielding structure; (h) coating a second photoresist layer on the laminated metal layer; (i) performing another exposure and developing process to the second photoresist layer by using a second photomask, so as to form a pattern that covers the areas for forming metal electrodes; (j) etching the laminated metal layer not covered by the second photoresist layer to form a plurality of pairs of metal electrodes on the corresponding transparent electrodes; and (k) removing the second photoresist.

BRIEF DESCRIPTION OF THE DRAWINGS

Other objects, features, and advantages of the present invention will become apparent by way of the following detailed description of a preferred but non-limiting embodiment. The description is made with reference to the accompanying drawings in which.

DESCRIPTION OF THE PREFERRED EMBODIMENT

Figure 1:
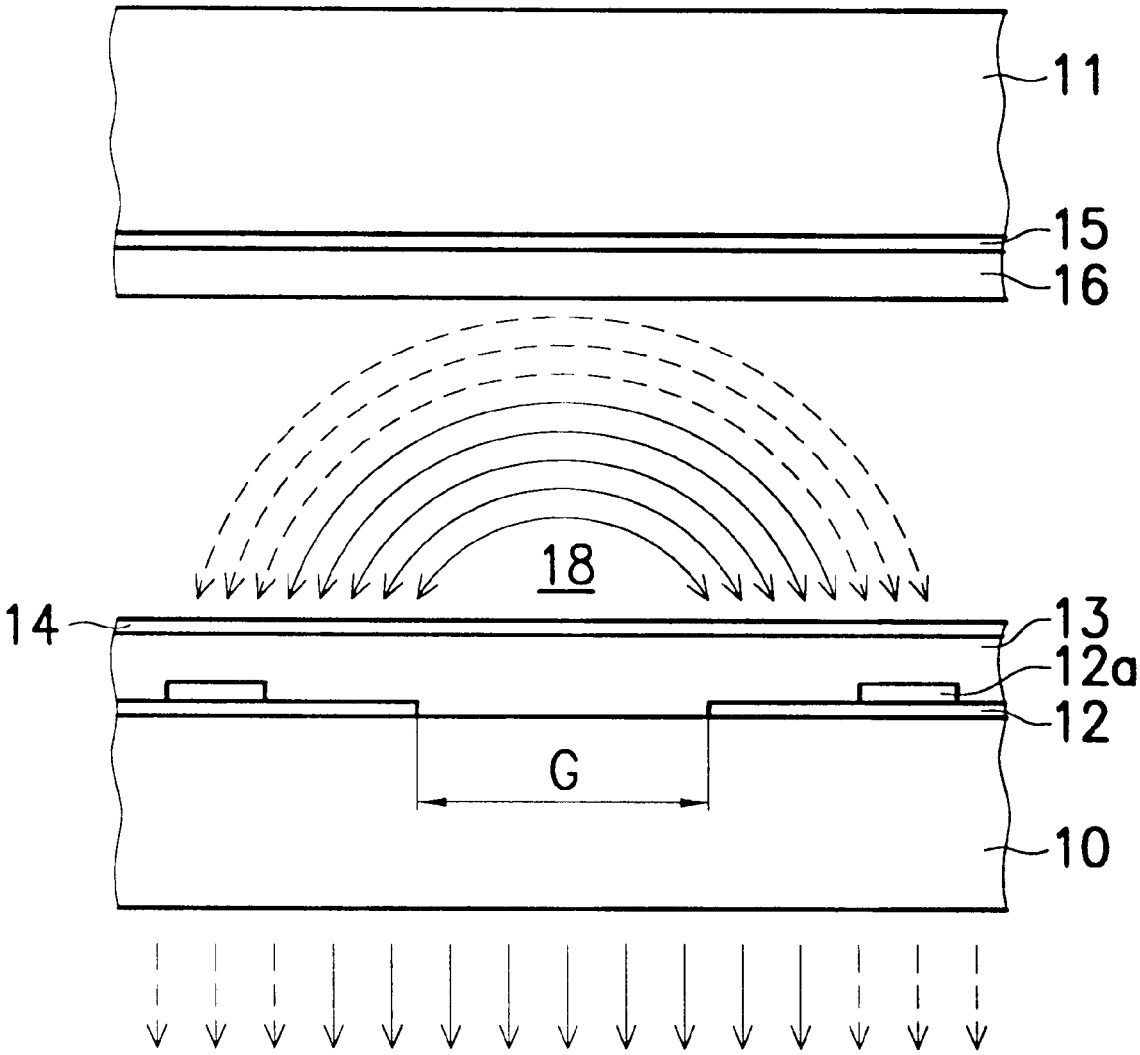
FIG. 1 is a partial cross-sectional view of a conventional PDP.
Figure 2A:
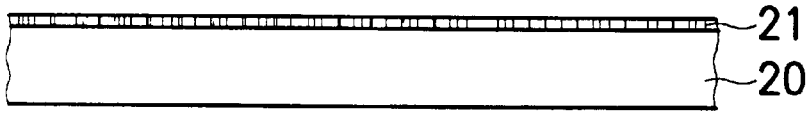
FIG. 2A (PRIOR ART)
FIGS. 2A to 2J are cross-sectional diagrams illustrating the process flow of a conventional method of fabricating a front plate for a PDP.
Figure 2B:
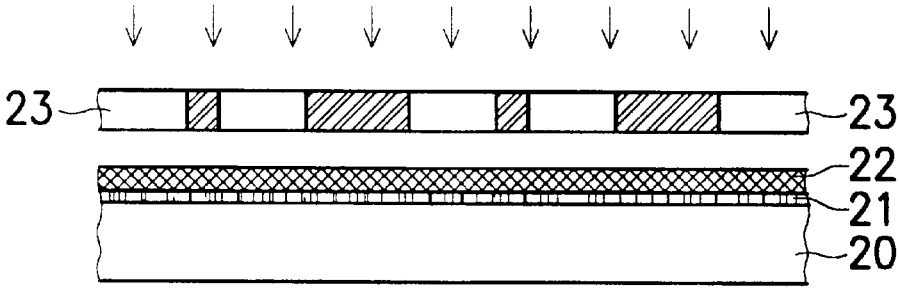
FIG. 2B (PRIOR ART)
Figure 2C:
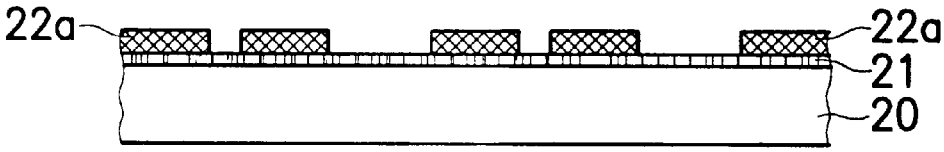
FIG. 2C (PRIOR ART)
Figure 2D:
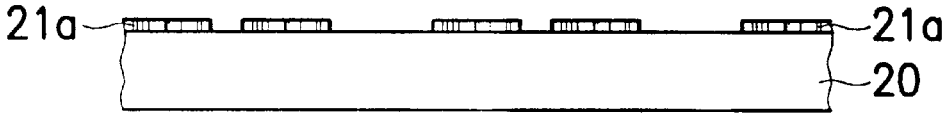
FIG. 2D (PRIOR ART)
Figure 2E:
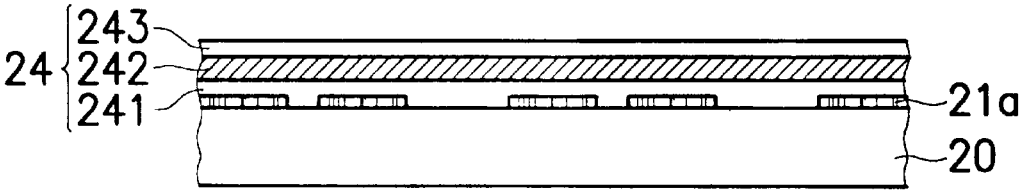
FIG. 2E (PRIOR ART)
Figure 2F:
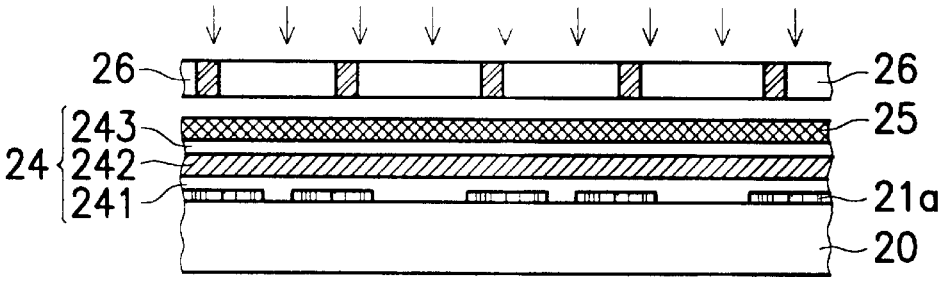
FIG. 2F (PRIOR ART)
Figure 2G:
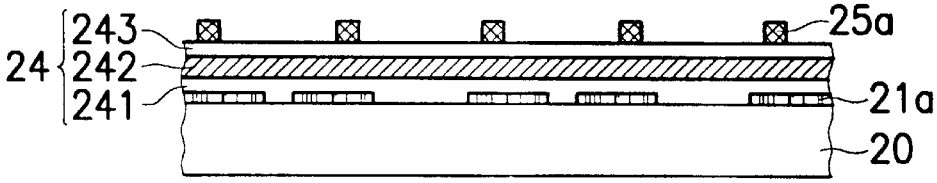
FIG. 2G (PRIOR ART)
Figure 2H:
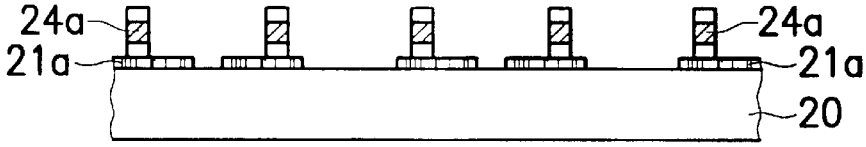
FIG. 2H (PRIOR ART)
Figure 2I:
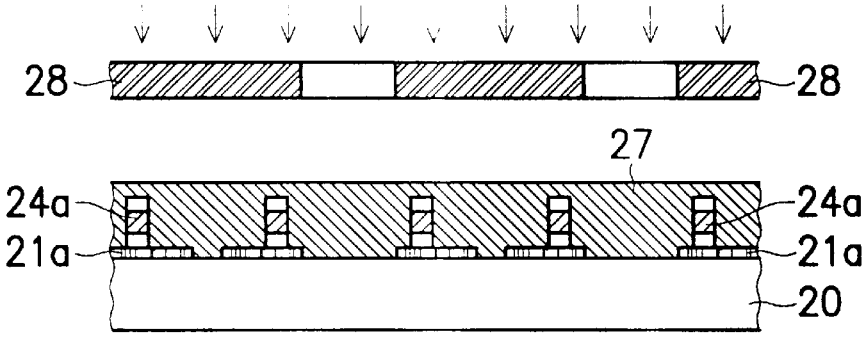
FIG. 2I (PRIOR ART)
Figure 2J:
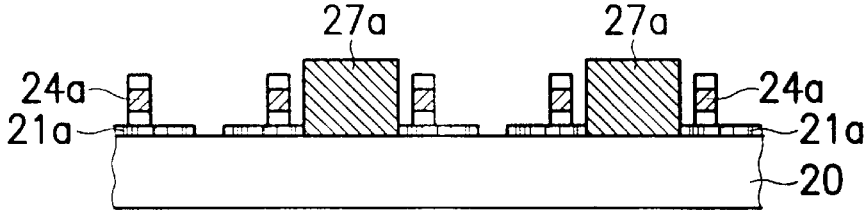
FIG. 2J (PRIOR ART)
Figure 3A:
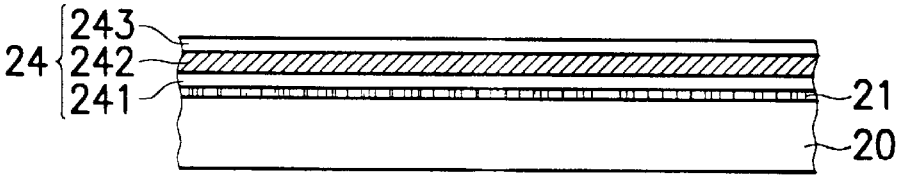
FIG. 3A (PRIOR ART)
FIGS. 3A to 3I are cross-sectional diagrams illustrating the process flow of a prior art modified method of fabricating a front plate for a PDP.
Figure 3B:
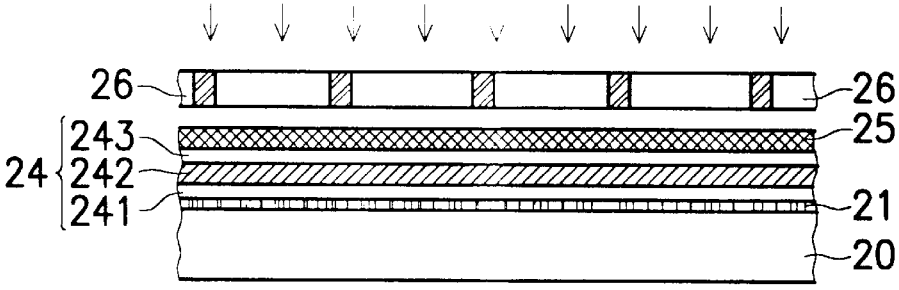
FIG. 3B (PRIOR ART)
Figure 3C:
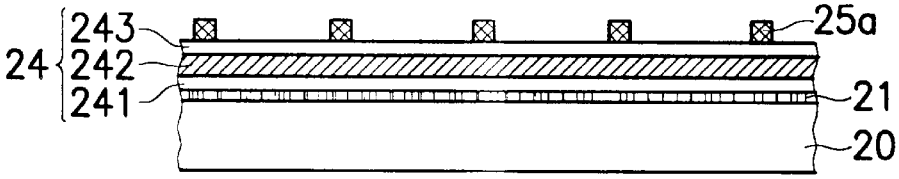
FIG. 3C (PRIOR ART)
Figure 3D:
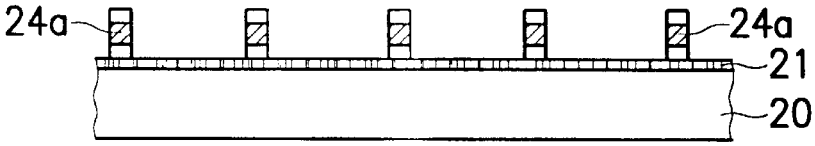
FIG. 3D (PRIOR ART)
Figure 3E:
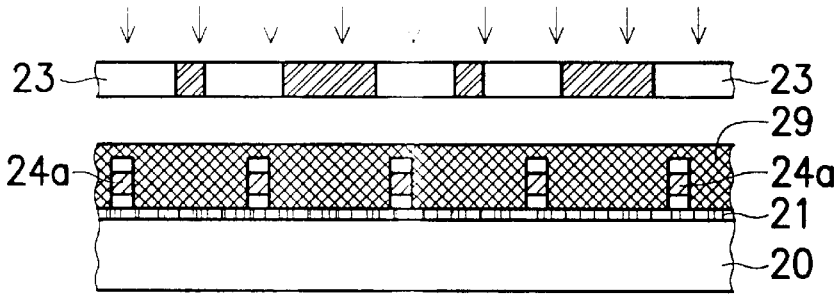
FIG. 3E (PRIOR ART)
Figure 3F:
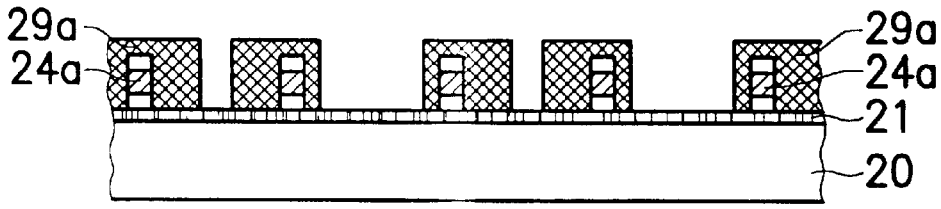
FIG. 3F (PRIOR ART)
Figure 3G:
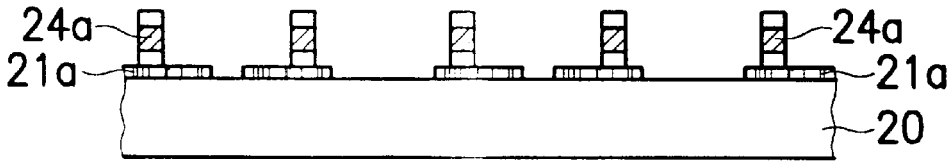
FIG. 3G (PRIOR ART)
Figure 3H:
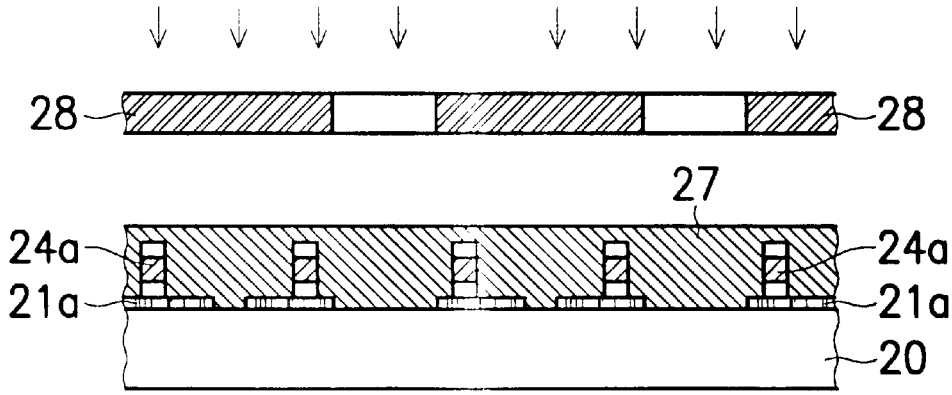
FIG. 3H (PRIOR ART)
Figure 3I:
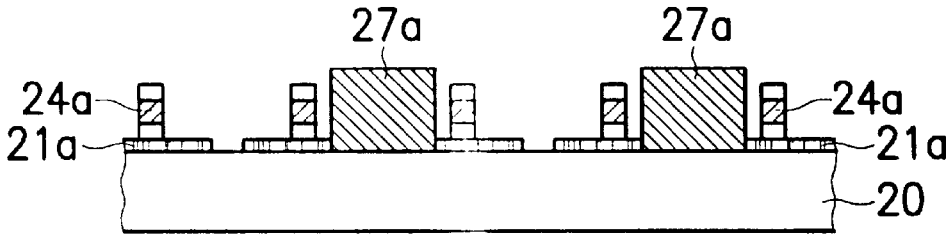
FIG. 3I (PRIOR ART)
Figure 4A:
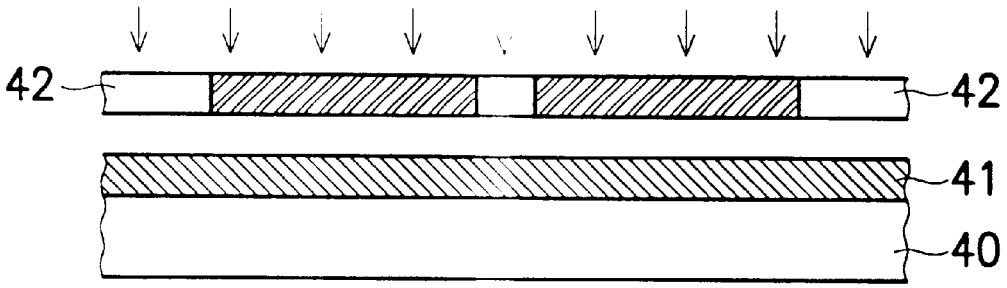
FIGS. 4A to 4H are cross-sectional diagrams illustrating the processing steps in accordance with a preferred embodiment of the present invention.
Figure 4B:
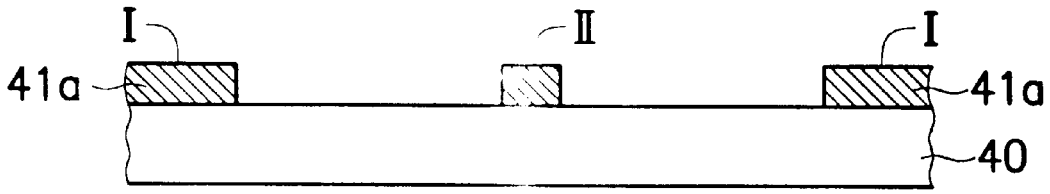

The substrate 40 shown in FIG. 4A is a glass plate. A light-shielding layer 41 containing a light-sensitive compound, such as the $PbO—Ba_2O_3—SiO_2$ series materials, is formed overlying the substrate 40. An exposure and developing process using the first photomask 42 is then executed directly toward the light-shielding layer 41 to define the light-shielding structure 41*a*; i.e., the exposed potion of the light-shielding layer 41 corresponding to the light-passing area of the first photomask 42 is hardened and left as the light-shielding structure 41*a*. Differing from the prior art, we here modify the pattern of the photomask 42 so that the resulting light-shielding structure 41*a* includes not only the "black stripes I" between two different pixels, but also the "transparent electrodes gap stoppers II" between two transparent electrodes in the same pixel. Besides the above photolithography process scheme (i.e. exposure and developing photoresist), the light-shielding structure 41*a* can be fabricated by the conventional mesh printing process as well.

Figure 4C:
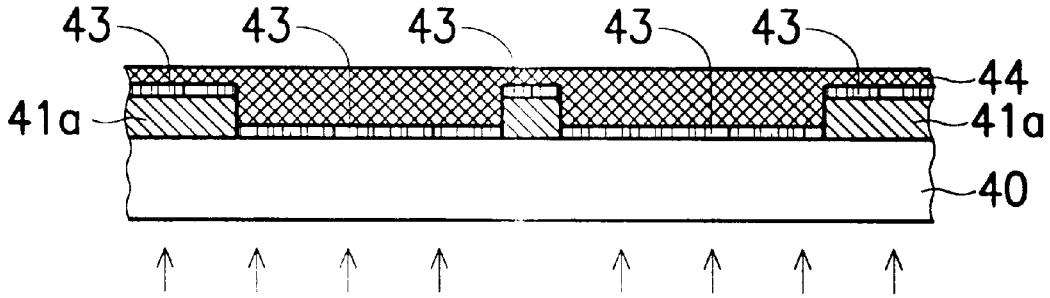
Figure 4D:
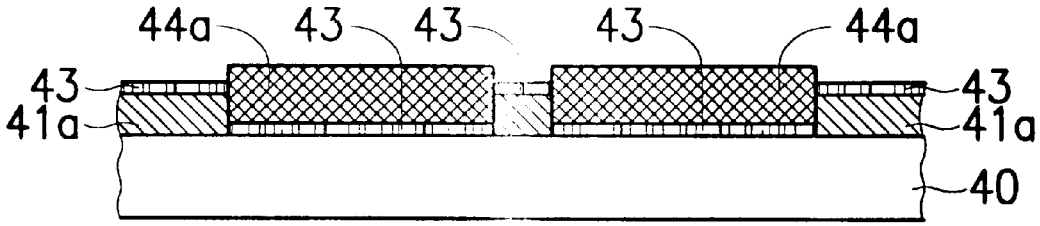
Figure 4E:
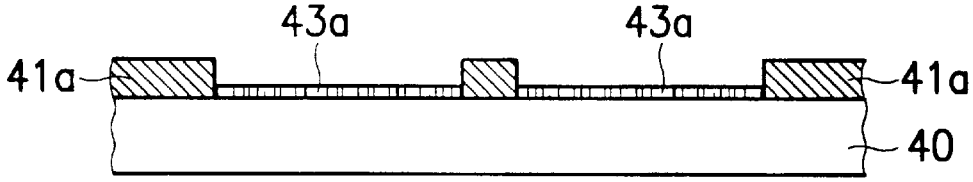

Next, referring to FIG. 4C, a transparent conductive layer 43, such as a Indium tin oxide (ITO), Tin oxide (SnO2), or Indium zinc oxide layer, is preferably formed overlying the upper surfaces of the light-shielding structure 41*a* and the substrate 40. However, it is acceptable in current step to have the ITO layer formed on the sidewall of the light-shielding structure 41*a*. Because the ITO layer stacked over the light-shielding structure 41*a* will be completely removed later as shown in FIG. 4E, the ITO left on the sidewall won't make two electrodes conductive together.

A Negative-type photoresist layer 44 (first photoresist layer) is formed overlying the transparent conductive layer 43 and the first photoresist layer 44 is preferably high enough to cover the sidewall of the light-shielding structure 41*a*. However, it is acceptable in current step to have the first photoresist layer 44 not cover the sidewall of the light-shielding structure 41*a*. Because the ITO layer can be removed using the directional dry etching later, there is no need to protect the sidewall of the light-shielding structure 41*a*.

Then, using the light-shielding structure 41*a* as a mask, a backside exposure process is performed to the first photoresist layer 44. In other words, a light source (not shown) located below the substrate 40 emits the light through the substrate 40 body and into the first photoresist layer 44 not blocked by the light-shielding structure 41*a*. An appropriate developing process is then performed to make the exposed first photoresist layer 44 harden to form a first photoresist pattern 44*a*, as shown in FIG. 4D. The first photoresist pattern 44*a* reveals a portion of the transparent conductive layer 43 stacked over the light-shielding structure 41*a*.

After that, using the first photoresist pattern 44*a* as a mask, an etching process is performed to remove the exposed portion of the transparent conductive layer 43 stacked over the light-shielding structure 41*a*. After that, an appropriate solvent or a dry etching process is applied to remove the first photoresist pattern 44*a*, resulting in the structure shown in FIG. 4E. Therefore, a plurality of transparent electrodes 43*a* are formed on the surface of the substrate 40, and the plurality of transparent electrodes 43*a* are separated by the black stripe (41*a*-I) or the transparent electrode gap stopper (41*a*-II).

Figure 4F:
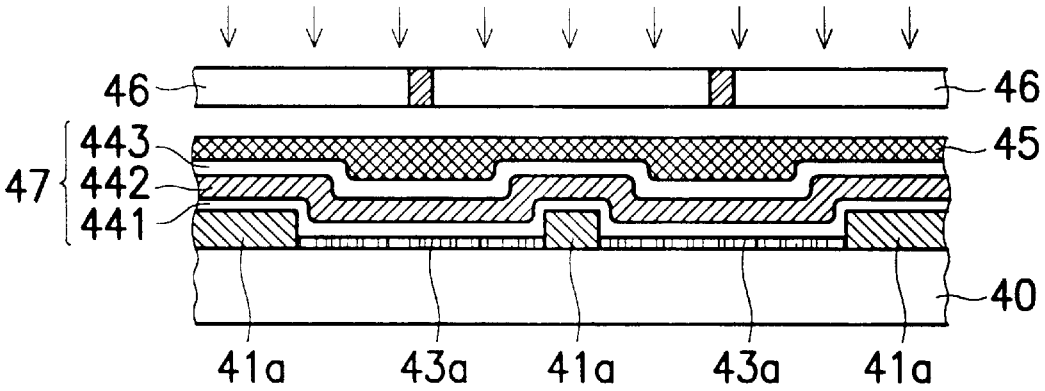

Referring to FIG. 4F, a laminated metal layer 47 is formed overlying the surfaces of the transparent electrodes 43*a* and the light-shielding structure 41*a*. The laminated metal layer 47 can be a three-layer stacked structure of, for example, chromium layer 441/copper layer 442/chromium layer 443 (Cr/Cu/Cr), or chromium layer 441/aluminum layer 442/chromium layer 443 (Cr/Al/Cr). Thereafter, a positive-type photoresist layer 45 (second photoresist layer) is coated on the surface of the laminated metal layer 47.

Figure 4G:
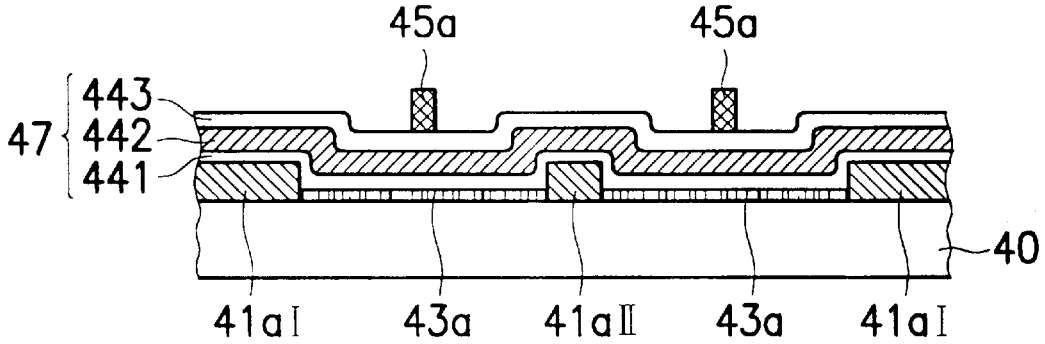

As shown in FIG. 4F~4G, another exposure and developing process is performed to the second photoresist layer by using a second photomask 46, to define a second photoresist pattern 45*a* that covers the laminated metal layer 47 only at the portion forming the metal electrodes later.

Figure 4H:
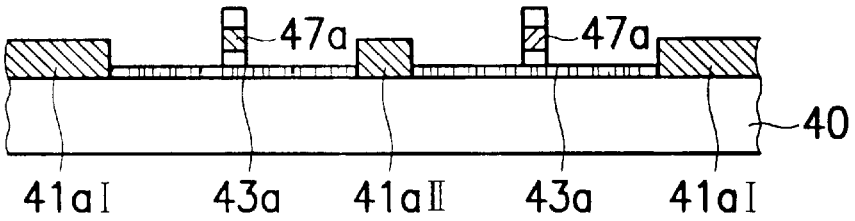

Then, using the second photoresist pattern 45*a* as a mask, the laminated metal layer 47 is etched to form a metal electrode 47*a* on the corresponding transparent electrode 43*a*. After removing the second photoresist pattern 45*a* by using an appropriate solvent or dry etching, the resulting structure is shown in FIG. 4H. Subsequently, a dielectric layer and a passivation layer (not shown) can be formed overlying the whole area successively to complete the fabrication of the front plate for a PDP.

Obviously, no manual-alignment is needed in any of the processing steps of the present invention. First, when the first photomask 42 is used to define the pattern of the light-shielding layer, a predefined alignment mark (not shown) on the substrate 40 is easily detected by the exposure platen's detector to help execute an auto-alignment exposure process. Next, the backside exposure process is applied to define the pattern of the photoresist layer 44. This is a self-aligned process in which no photomask is needed. Finally, the second photomask 46 is used to define the pattern of the photoresist layer 45. The alignment mark is now transferred onto the light-shielding layer 41. The exposure platen's detector can detect it with no difficulty, so that an auto-alignment is achieved. With this whole auto-alignment and self-alignment scheme, the exposure accuracy and the production efficiency are improved. In addition, only two photomasks are required in this invention process. The complexity and cost of fabrication can be reduced accordingly.

While the invention has been described by way of example and in terms of preferred embodiments, it is to be understood that the invention is not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A method of fabricating a front plate for a plasma display panel, comprising the steps of:

(a) forming a light-shielding structure on a substrate by a mesh printing process or a photolithography process, said light-shielding structure including a black stripe and a transparent electrode gap stopper;

(b) forming a transparent conductive layer overlying the upper surfaces of said light-shielding structure and said substrate;

(c) coating a first photoresist layer overlying said transparent conductive layer;

(d) performing a backside exposure and developing process to the first photoresist layer by using said light-shielding structure as a mask to form a first photoresist pattern, wherein said first photoresist pattern reveals a portion of said transparent conductive layer stacked over said light-shielding structure;

(e) removing said portion of said transparent conductive layer stacked over said light-shielding structure;

(f) removing the first photoresist pattern, thereby leaving a plurality of transparent electrodes formed on said substrate, and said plurality of transparent electrodes are separated by said black stripe or said transparent electrode gap stopper;

(g) forming a metal layer overlying said transparent electrodes and said light-shielding structure;

(h) coating a second photoresist layer on said metal layer;

(i) forming a second photoresist pattern by performing another photolithography process to the second photoresist layer using a second photomask;

(j) etching said metal layer not covered by the second photoresist pattern to form a metal electrode on the corresponding transparent electrode; and (k) removing the second photoresist pattern.

2. A method of fabricating a front plate for a plasma display panel (PDP) according to claim 1, wherein said substrate of step (a) is a glass plate.

3. A method of fabricating a front plate for a plasma display panel (PDP) according to claim 1, wherein the pattern of said light-shielding layer corresponds to the light-passing area of the first photomask.

4. A method of fabricating a front plate for a plasma display panel (PDP) according to claim 1, wherein said transparent conductive layer of step (b) is made of Indium tin oxide (ITO), Tin oxide ($SnO_2$), or Indium zinc oxide.

5. A method of fabricating a front plate for a plasma display panel (PDP) according to claim 1, wherein the first photoresist layer of step (c) is a negative-type photoresist layer.

6. A method of fabricating a front plate for a plasma display panel (PDP) according to claim 1, wherein said metal layer of step (g) is a chromium/copper/chromium (Cr/Cu/Cr) stacked layer or a chromium/aluminum/chromium (Cr/Al/Cr) stacked layer.

7. A method of fabricating a front plate for a plasma display panel (PDP) according to claim 1, wherein said photolithography process of step (a) and said another photolithography process of step (i) are performed in an auto-alignment manner.

* * * * *